US008322833B2

(12) United States Patent
Grossrubatscher

(10) Patent No.: US 8,322,833 B2
(45) Date of Patent: Dec. 4, 2012

(54) INK SUPPLY SYSTEM FOR AN INKJET PRINTER

(75) Inventor: Georg Grossrubatscher, Bruneck (IT)

(73) Assignee: Durst Phototechnik—A.G. (IT)

( * ) Notice: Subject to any disclaimer, the term of this patent is extended or adjusted under 35 U.S.C. 154(b) by 291 days.

(21) Appl. No.: 12/600,118

(22) PCT Filed: May 13, 2008

(86) PCT No.: PCT/EP2008/003810

§ 371 (c)(1),
(2), (4) Date: Nov. 13, 2009

(87) PCT Pub. No.: WO2008/138586

PCT Pub. Date: Nov. 20, 2008

(65) Prior Publication Data

US 2010/0302324 A1 Dec. 2, 2010

(30) Foreign Application Priority Data

May 14, 2007 (AT) ..... A 746/2007

(51) Int. Cl.
*B41J 2/175* (2006.01)

(52) U.S. Cl. ..... 347/85

(58) Field of Classification Search ..... 347/7, 42, 347/43, 84, 85; 141/2, 18
See application file for complete search history.

(56) References Cited

U.S. PATENT DOCUMENTS

| | | | | |
|---|---|---|---|---|
| 4,342,042 | A * | 7/1982 | Cruz-Uribe et al. | 347/7 |
| 6,431,683 | B1 * | 8/2002 | Ho et al. | 347/50 |
| 6,435,653 | B1 * | 8/2002 | Boyd et al. | 347/42 |
| 6,840,604 | B2 * | 1/2005 | Kimura et al. | 347/85 |
| 7,654,657 | B2 * | 2/2010 | Seshimo | 347/85 |
| 7,775,615 | B2 * | 8/2010 | Yasuda | 347/10 |
| 2003/0210309 | A1 | 11/2003 | Kimura et al. | |
| 2006/0007254 | A1 | 1/2006 | Tanno et al. | |
| 2007/0070106 | A1 | 3/2007 | Yasuda | |

FOREIGN PATENT DOCUMENTS

| | | | |
|---|---|---|---|
| DE | 2449732 | B1 | 1/1976 |
| DE | 19532726 | A1 | 4/1996 |
| EP | 1234673 | A2 | 8/2002 |
| WO | 0187624 | A1 | 11/2001 |
| WO | 2005102708 | A1 | 11/2005 |
| WO | 2006084614 | A2 | 8/2006 |

OTHER PUBLICATIONS

International Search Report, PCT/EP2008/003810, dated Sep. 15, 2008.

* cited by examiner

*Primary Examiner* — Anh T. N. Vo

(74) *Attorney, Agent, or Firm* — Lerner, David, Littenberg, Krumholz & Mentlik, LLP

(57) ABSTRACT

The invention describes an ink supply system (2) for an inkjet printer (1) with a print head arrangement (6) for at least one color, wherein the print head arrangement (6) comprises several print heads (7) each with several jets, and wherein the print heads (7) are arranged in a row next to one another to form a complete printing area width (10) corresponding to a multiple of a printing area width (9) of an individual print head (7). Each of the print heads (7) is connected by a line to an intermediate tank (12) for ink of the respective color, wherein several print heads (7) are connected to a common intermediate tank (12).

15 Claims, 1 Drawing Sheet

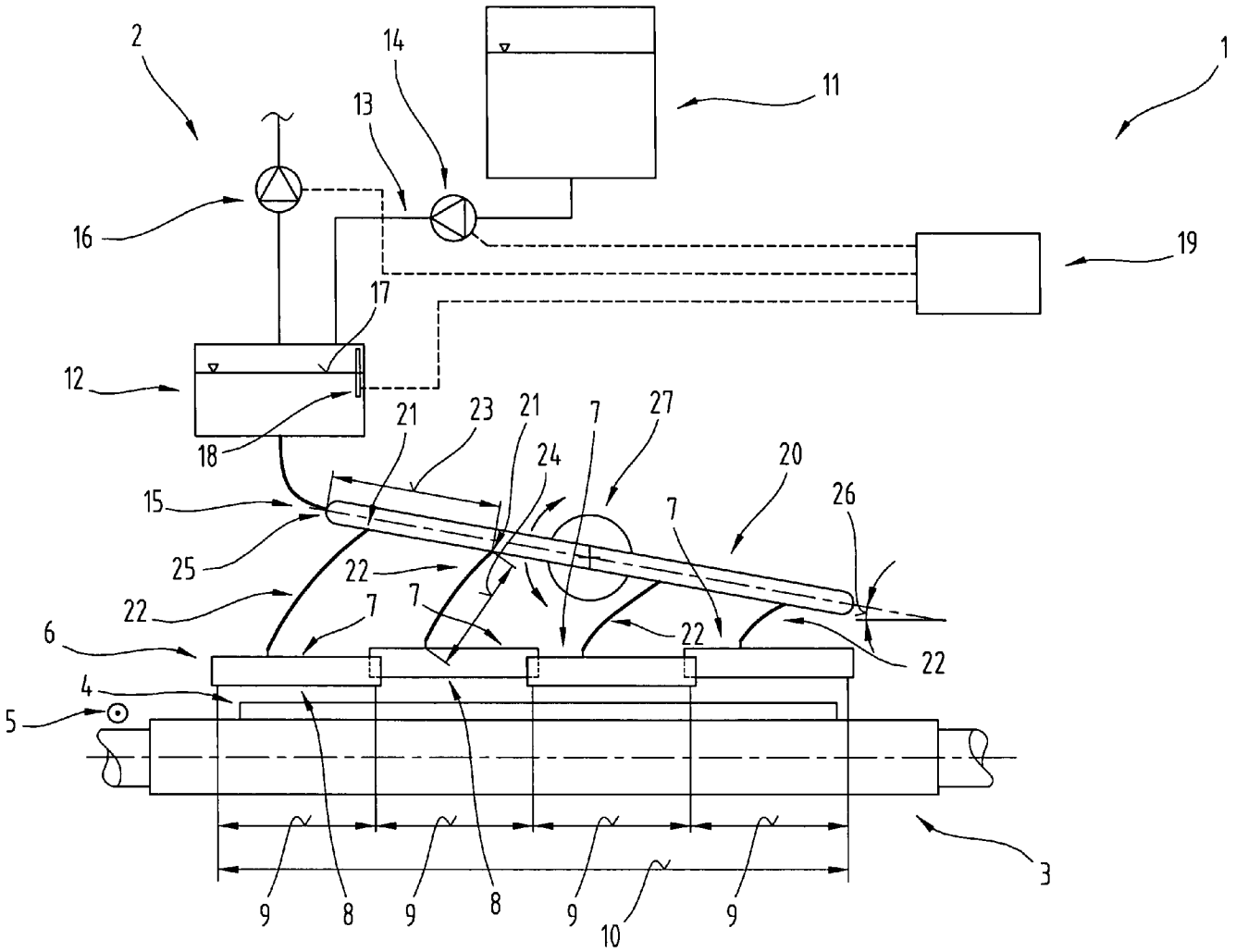
1
2
3
4
5
6
7
8
9
10
11
12
13
14
15
16
17
18
19
20
21
22
23
24
25
26
27

INK SUPPLY SYSTEM FOR AN INKJET PRINTER

CROSS REFERENCE TO RELATED APPLICATIONS

The present application is a national phase entry under 35 U.S.C. §371 of International Application No. PCT/EP2008/003810, filed 13 May 2008, published in German, which claims the benefit of Austrian Patent Application No. A 746/2007, filed 14 May 2007. The disclosures of said applications are incorporated by reference herein.

The invention relates to an ink supply system for an inkjet printer according to the features of the preamble of claim 1.

Inkjet printers are already known, in which print head arrangements are used which are composed of several print heads. Said print heads are arranged in a row next to one another such that they span the entire width of the printing area, which corresponds to a multiple of the printing area width of an individual printing head. Print head arrangements of this kind are arranged to be stationary relative to a transport device on which the parts to the printed are transported during the printing process. An inkjet printer of this kind is described for example in document WO 2006/084614.

From document DE 24 49 732 an ink supply system for an inkjet printer is already known, which is designed so that ink is supplied continually to the print head at an almost constant pressure.

In high performance inkjet printers usually print heads with a large number of jets are used. Print heads of this kind for example with 128 jets per print head have to be supplied with ink for smooth operation, wherein the pressure of the ink has to be within a very narrow tolerance range. Inkjet printers, as described in WO 2006/084614, and so-called large format printers with printing area widths of up to several meters, have the advantage of very high throughput by using the described stationary print head arrangement. However, the narrow tolerance range for the ink pressure at the individual print heads means very high technical input and thus high costs to ensure the individually required supply of ink.

The objective of the present invention is therefore to produce an ink supply system for an ink-jet printer with a print head arrangement composed of individual print heads, which can be assembled with relatively few, technically simple components in an inexpensive manner.

The objective of the invention is achieved by means of an ink supply system according to the features of claim 1. It is advantageous to supply several print heads from a common intermediate tank with a considerable reduction in the space requirement for the components of the ink supply system and by reducing the components regulating the liquid pressure of the ink the likelihood of failure of a thus equipped inkjet printer is considerably reduced.

The developments of the ink supply system according to claims 2 to 4 are also advantageous as thereby the dimensioning of the individual line sections of the line network is made easier. The development according to claim 5, according to which the distributor tube is inclined in relation to a horiontal plane by an angle, as well as the developments according to claims 6 and 7 takes into consideration in an advantageous manner the various different lengths of the inlet canals to the print heads or to the print head modules, and at the same time ensures that air bubbles in the ink can escape upwards without any restriction, i.e. from the intermediate path.

Also the developments of the ink supply system according to claims 8 and 9 are advantageous, as thus the line system connecting the intermediate path with the print heads can be structured simply.

By means of the development of the ink supply system according to claim 10 in an advantageous manner the same pressure conditions of the ink liquid in the print heads can be achieved as far as possible.

Making the inlet canals, as provided in claim 11, in the form of hoses has the advantage that a very flexible adjustment of the flow lengths of the inlet channels can be achieved. In particular with the required corrections to the necessary flow resistance it is possible to obtain a return channel simply by exchanging a hose of a different length.

The development of the ink supply systems according to claim 12 is advantageous in that in this way the inlet channels formed by hoses can be adjusted as far as possible in an extended position.

By connecting a vacuum pump to the intermediate tank, according to claim 13 any unwanted outflow of ink from the jets of the print heads can be prevented.

The developments of the ink supply systems according to claims 14 and 15 are also advantageous, as in this way an automated monitoring and control of the filling level in the intermediate tank is possible.

For a better understanding of the invention the latter is explained in more detail with reference to the following FIGURE.

In a simplified represenation:

FIG. 1 shows an inkjet printer with an ink supply system.

First of all, it should be noted that in the variously described exemplary embodiments the same parts have been given the same reference numerals and the same component names, whereby the disclosures contained throughout the entire description can be applied to the same parts with the same reference numerals and same component names. Also details relating to position used in the description, such as e.g. top, bottom, side etc. relate to the currently described and represented figure and in case of a change in position should be adjusted to the new position. Furthermore, also individual features or combinations of features from the various exemplary embodiments shown and described can represent in themselves independent or inventive solutions.

FIG. 1 shows an inkjet printer 1 with an ink supply system 2. For a better overview the ink supply system 2 is shown for only one colour or ink. In an inkjet printer 1 for printing multi-coloured pictures the ink supply systems 2 are provided with the corresponding number of colours.

The inkjet printer comprises a horizontally arranged transport device 3 for moving a printing part 4 lying thereon to be printed in a feed direction 5 (according to the view perpendicular to the plane of the drawing). Above the transport device 3 is a print head arrangement 6 with print heads 7, by means of which the printing part 4 moved along underneath is printed with ink.

The transport device 3 is formed for example by a rotating conveyor belt, which is guided or driven by at least two turning rollers. The upper section moved in the feed direction 5 of the conveyor belt is supported by one or more guiding plates on its lower side, so that a suitably even horizontal movement of the printing part 4 is achieved in the feed direction 5. The print head arrangement 6 comprises for each colour a plurality of print heads 7 so that the entire width of the print medium or the printing parts 4 can be printed at once without the print head arrangement 6 having to move in a lateral direction relative to the feed direction. The print head arrangement 6 is arranged to be fixed in lateral direction or to be stationary with respect to the transport direction 3 during printing.

Each of the print heads 7 has a row of jets 8 formed by a plurality of adjacent and usually linearly aligned jets. In print heads 7, as usually used in so-called large format printers, mostly on the basis of piezoelectric ink ejection, the row of jets 8 contains for example 128 adjacently arranged jets (for a better overview not shown in FIG. 1). An individual print head 7 or row of jets 8 comprises accordingly a printing area width 9 measured perpendicular to the feed direction 5. The print heads 7 or their rows of jets 8 are arranged closely together in a row so that there is a total printing area width 10 of the printing head arrangement 6. In order that the printing area width 9 of the rows of jets 8 can be arranged in a row adjacent to one another without any gaps, the print heads 7 have to be arranged offset alternately in relation to the feed direction 5, which is indicated in the view accordng to FIG. 1 in addition by a slight vertical offset. The print heads 7 could be arranged not to be perpendicular but oblique in relation to the feed direction 5, whereby vice versa a smaller printing area width 9 can allow a greater resolution or pixel density.

The ink supply system 2 firstly comprises a main tank 11, from which the intermediate tank 12 is supplied with ink. In addition, an inlet channel 13 is provided with a pump 14. To supply the print heads 7 with ink from the intermediate tank 12, the latter is connected with the print head arrangement 6 or the print heads 7 by a line network 15. In this way several print heads are connected respectively by a line to the common intermediate tank 12. In this case all of the line sections of the line network 15 connecting the intermediate tank 12 to the print heads 7 are sloped downwards from the intermediate tank 12 to the print heads 7. This has the advantage that air bubbles, which may form for various reasons in the conveyed ink, can always escape upwards and thus disruption to the functioning of a print head 7 can be avoided.

The intermediate tank 12 remains connected to a vacuum pump 16, so that the air located in the ink above a liquid level 17 of the ink can be exposed to pressure that is lower than the environmental air pressure. This is necessary to prevent the filled inks escaping through the jet openings of the print heads 7 due to the inherent weight of the ink. In the intermediate tank 12 there is also a filling level sensor 18, by means of which the level of the liquid level 17 or filling level of the intermediate tank 12 with ink can be measured. By means of the filling level sensor 18 it is possible to monitor in a control 19 the level of liquid 17 in the intermediate tank 12 and by driving the pump 14 accordingly only enough ink is inserted from the main tank 11 to keep the level of liquid 17 constant.

It is important to keep the level of the liquid 17 constant, since the hydrostatic pressure of the ink corresponding to the height difference between the liquid level 17 and the jet openings in the print heads 7 is also responsible for the pressure ratios of the ink liquid in the print heads 7 and thus for smooth operation. Thus when stationary, i.e. when no ink is ejected through the jets of the print heads 7 and there is thus no flow of ink in the line network 15, the sum of the air pressure above the liquid level 17 in the intermediate tank 12 and the hydrostatic pressure of the ink liquid is exactly the same as the air pressure of the environment. In the operating state in which ink is ejected through the jets of the print heads 7 because of the flow resistance associated with the flow of ink in the lines of the line network 15 there is a loss in pressure reducing the liquid pressure of the ink in the print heads 7. The air pressure generated by the vacuum pump 16 above the liquid level 17 in the intermediate tank 12 is thus set so that the liquid pressure of the ink in the print heads 7 in every operating state is between standstill and maximum ink ejection in a pressure tolerance field required for the smooth operation of the print heads 7.

In general terms, the low pressure and the air pressure above the liquid level 17 can be adjusted, so that on the one hand it is not too low and ink is prevented from running out of the jets and on the other hand is not too high, as otherwise ink is suctioned inside the print head and air can thus enter from the outside through the jet openings, which may result in a failure of the jets if the piezo chamber is filled with air. Additional effects, which can also influence the printing status of the print heads 7, are increasing pressure losses caused by the increasing blockaging of possibly used degassing or filtering units (not shown in FIG. 1) in the lines of the line network 15. Furthermore, fluctuations in pressure are also possible, which may occur when refilling ink into the intermediate tank 1, as well as fluctuations in pressure caused by differences in the level of the liquid 17 in the intermediate tank 12, as mentioned above. The flow resistance or the tube friction losses are however influenced heavily by line lengths and the output cross sections of the lines in the line network 15.

With the ink supply system according to the invention it is firstly the case that several print heads 7 are connected to the common intermediate tank 12 and are supplied with ink of the respective colour. In the line network 15 connecting the intermediate tank 12 to the print heads 7 of the print head arrangement 6 a distributor 20 is also provided. The distributor 20 is preferably formed by a distributor tube with a regular tube cross section and a linear shape. In the distributor tube 20 there are outlet openings 21 for inlet channels 22 for the print heads 7, whereby the distances between consecutive outlet openings 21 are equal with respect to a longitudinal extension of the distributor tube. A spacing between two consecutive outlet openings 21 is preferably the same as the printing area width 9, i.e. a spacing between two consecutive print heads 7. The distributor tube 20 is in this case substantially linear and parallel to the extension of the print head arrangement 6 according to the entire printing area width 10.

As also described in WO 2006/084614 A several print heads 7 can be combined to form a structural unit, i.e. a so-called print head module. The above description relating to the printing area widths 9 of the print heads 7 and the structure of the print head arrangement 6 can thus be applied to print head modules consisting of several print heads 7. According to the invention it is also possible for one inlet channel 22 to be provided to supply such a print head module formed by several print heads 7 with ink. Accordingly the distance between two consecutive outlet openings then equals the distance or the printing area width between two consecutive print head modules.

The line connecting the intermediate tank 12 with a print head 7 or a print head module comprises a first line section 23 common to several print heads 7 or several print head modules and a separate inlet channel 22 respectively to the print head 7 or the print head module. The inlet channels 22 leading to the print heads 7 are preferably formed by flexible hoses. The length 24 of consecutive inlet channels 22 is shorter the greater the distance of the respective outlet opening 21 from the intermediate tank measured relative to the longitudinal extension of the distributor tube 20. In this case the highest point 25 of the distributor tube 20 is connected to the intermediate tank 12. The lengths 24 of the inlet channels 22 are measured so that for the operational state of maximum ink ejection through the jets of the print heads 7 the sum of print losses, caused by flow resistance in the respective inlet channel 22 and the corresponding line section 23, is the same as far as possible for all inlet channels 22 connected to the distributor tube 20.

The distributor tube 20 provided in the line network 15 is arranged to be inclined by an angle 26 relative to a horizontal plane. This angle 26 can be changed, in that the distributor tube 20 is mounted on an adjusting device 27, so that the inclination can be adjusted. The adjusting device 27 can also be formed alternatively by a mount different than shown in FIG. 1. Thus it is possible advantageously, to secure both ends of the distributor tube 20—for example provided with elongated holes—vertically adjustably on a frame part of the inkjet printer 1 by means of screws. This has the advantage of a more stable attachment. The angle 26 of inclination of the distributor tube 20 is preferably measured so that the inlet channels 22 are located in a largely extended position. By means of this arrangement of the distributor tube 20 and the inlet channels 22 it is possible for substantially uniform pressure conditions of the ink liquid to exist in all print heads 7 of the print head arrangement 6, and also all of the line sections in the line network 15 have a downwards inclination, so that as far as possible any air bubbles that are formed can escape upwards without any restriction.

All of the details relating to ranges of values in the present description should be understood such that the latter include any and all partial ranges, e.g. the range of 1 to 10 should be understood to include all partial ranges between the lower limit 1 and the upper limit 10, i.e. all partial ranges begin with a lower limit of 1 or more and end with an upper limit of 10 or less, e.g. 1 to 1.7 or 3.2 to 8.1 or 5.5 to 10.

The exemplary embodiments show possible variants of the ink supply system, whereby it should be noted here that the invention is not restricted to the embodiments shown specifically but rather also different combinations of the individual embodiments are possible and this variability lies within the capability of a person skilled in this technical field using the teaching of the present invention. Also all possible variants, which are obtained by combining details of the embodiment variant shown and described, are covered by the scope of protection.

Finally, as a point of formality it is noted that for a better understanding of the structure of the ink supply system, the latter and its components have not been depicted wholly to scale and/have been enlarged and/or reduced in size.

The underlying problem of the independent solutions according to the invention can be taken from the description.

LIST OF REFERENCE NUMERALS

1 Inkjet printer
2 Ink supply system
3 Transport device
4 Printing part
5 Feed direction
6 Print head arrangement
7 Print head
8 Row of jets
9 Printing area width
10 Printing area width
11 Main tank
12 Intermediate tank
13 Inlet channel
14 Pump
15 Line network
16 Vacuum pump
17 Liquid level
18 Filling level sensor
19 Control
20 Distributor
21 Outlet opening
22 Inlet channel
23 Line section
24 Length
25 Point
26 Angle
27 Adjusting device

The invention claimed is:

1. An ink supply system for an inkjet printer comprising: a print head arrangement for at least one color, wherein the print head arrangement comprises several print heads each with several jets, and wherein the print heads are arranged in a row next to one another to form a complete printing area width corresponding to a multiple of a printing area width of an individual print head, and wherein each of the print heads is connected by a line to an intermediate tank for ink of the respective color and wherein several print heads are connected to a common intermediate tank, wherein the line forms a distributor, which is formed by a distributor tube, and wherein the distributor tube is inclined by an angle relative to a horizontal plane.

2. The ink supply system of claim 1, wherein the distributor forms a first line section common to several print heads and comprises a separate inlet channel respectively to the print head.

3. The ink supply system of claim 2, wherein the inlet channels are in the form of hoses.

4. The ink supply system of claim 1, wherein several print heads form a print head module, wherein the print head arrangement comprises several print head modules, and in that the line connecting the intermediate tank with the print head module forms the distributor, which also forms a first line section common to several print head modules, and comprises a separate inlet channel respectively to the print head module.

5. The ink supply system of claim 1, wherein the highest point of the distributor tube is connected to the intermediate tank.

6. The ink supply system of claim 1, wherein all of the line sections connecting the intermediate tank to the print head have a downward slope directed from the intermediate tank to the print head.

7. The ink supply system of claim 1, wherein outlet openings of the distributor tube to the inlet channels for the print heads are arranged equidistantly with respect to a longitudinal extension of the distributor tube.

8. The ink supply system of claim 7, wherein the distance between two consecutive outlet openings is the same as the distance between two consecutive print heads or is the same as the distance between two consecutive print head modules.

9. The ink supply system of claim 8, wherein the length of consecutive inlet channels is smaller the greater the distance of the respective outlet opening from the intermediate tank measured in relation to the longitudinal extension of the distributor tube.

10. The ink supply system of claim 1, wherein the distributor tube is mounted on an adjusting device adapted to adjust the angle of inclination relative to the horizontal plane

11. The ink supply system of claim 1, wherein the intermediate tank is connected to a vacuum pump for generating pressure that is lower than the external air pressure.

12. The ink supply system of claim 1, wherein the intermediate tank is connected to a main tank for refilling with ink.

13. The ink supply system of claim 1, wherein in the intermediate tank a filling level sensor is arranged for measuring the filling level of the intermediate tank with ink.

14. An ink supply system for an inkjet printer comprising: a print head arrangement for at least one color, wherein the print head arrangement comprises several print heads each with several jets, and wherein the print heads are arranged in a row next to one another to form a complete printing area width corresponding to a multiple of a printing area width of an individual print head, and wherein each of the print heads is connected by a line of a line net-work comprising several line sections to an intermediate tank for ink of the respective color and wherein several print heads are connected to a common intermediate tank, wherein the line forms a distributor, which distributor is formed by a distributor tube, and wherein all of the line sections in the line network have a downwards inclination.

15. The ink supply system of claim 14, wherein the distributor tube is in-clined by an angle relative to a horizontal plane.

* * * * *